US007004121B2

(12) United States Patent
Moe et al.

(10) Patent No.: US 7,004,121 B2
(45) Date of Patent: Feb. 28, 2006

(54) ARRANGEMENT AT A PISTON ENGINE AND METHOD OF CONTROLLING THE PISTONS

(75) Inventors: Magne Mathias Moe, Harstad (NO); Åge Kyllingstad, Ålgård (NO)

(73) Assignee: National Oilwell Norway AS, (NO)

( * ) Notice: Subject to any disclaimer, the term of this patent is extended or adjusted under 35 U.S.C. 154(b) by 0 days.

(21) Appl. No.: 10/380,434

(22) PCT Filed: Sep. 13, 2001

(86) PCT No.: PCT/NO01/00374

§ 371 (c)(1),
(2), (4) Date: Jul. 17, 2003

(87) PCT Pub. No.: WO02/23040

PCT Pub. Date: Mar. 21, 2002

(65) Prior Publication Data

US 2004/0011193 A1 Jan. 22, 2004

(30) Foreign Application Priority Data

Sep. 15, 2000 (NO) ..... 20004596

(51) Int. Cl.
*F04B 9/04* (2006.01)

(52) U.S. Cl. ..... 123/56.2

(58) Field of Classification Search ..... 123/56.2, 123/56.8, 572
See application file for complete search history.

(56) References Cited

U.S. PATENT DOCUMENTS 766,410 A * 8/1904 Alger ..... 74/57
1,229,009 A * 6/1917 Allison ..... 74/56
1,339,276 A * 5/1920 Murphy ..... 74/56
1,466,144 A * 8/1923 Murphy ..... 123/56.8
1,788,140 A * 1/1931 Woolson ..... 123/51 AA
1,808,083 A * 6/1931 Tibbetts ..... 123/64
1,867,504 A * 7/1932 Franklin ..... 74/57

(Continued)

FOREIGN PATENT DOCUMENTS

DE 861 791 7/1949

(Continued)

*Primary Examiner*—Marguerite McMahon
(74) *Attorney, Agent, or Firm*—Andrus, Sceales, Starke & Sawall, LLP

(57) ABSTRACT

A piston engine in the form of a piston pump or a piston engine (motor) comprises two or more piston cylinders (14*b*, 14*c*), preferably positioned with the same angular distances of 180 degrees for two cylinders, 120 degrees for three cylinders etc. with regards to an axis, and each comprising a reciprocating piston with a projecting piston rod (18*b*, 18*c*). Via the piston rods (18*b*, 18*c*), each piston is given a controlled displacement matched to the controlled, given displacement of another or other pistons. The control means is rotatable and influences the projecting outer end portions of the piston rods or parts fitted to these, for instance rotatable rollers (20*b*, 20*c*). By a piston pump of this type, the pistons are to contribute to impelling a fluid flow, while a piston engine of this type shall be designed to be driven by a fluid flow. Operating conditions are aimed at which give a more even volume flow, i.e. without any significant fluctuations. For this purpose, said rotatable control means is designed with an encircling cam surface (52) which the piston rod ends abut via the peripheral surface of said rotatable rollers (20*b*, 20*c*). According to a feature of a method associated with the application of such a piston engine, each piston may with advantage be driven at a constant speed through part of its power stroke.

18 Claims, 11 Drawing Sheets

U.S. PATENT DOCUMENTS

| | | | | | |
|---|---|---|---|---|---|
| 1,931,543 | A | | 10/1933 | High | |
| 2,243,818 | A | * | 5/1941 | Herrmann | 123/41.31 |
| 4,233,156 | A | | 11/1980 | Tsukada et al. | |
| 4,359,312 | A | | 11/1982 | Funke et al. | |
| 4,432,310 | A | | 2/1984 | Waller | |
| 5,031,581 | A | | 7/1991 | Powell | |
| 5,215,045 | A | | 6/1993 | Vadnjal | |
| 5,309,872 | A | | 5/1994 | Filippi et al. | |
| 5,375,567 | A | * | 12/1994 | Lowi, Jr. | 123/56.8 |
| 5,551,383 | A | | 9/1996 | Novotny | |
| 5,890,462 | A | * | 4/1999 | Bassett | 123/56.2 |

FOREIGN PATENT DOCUMENTS

| | | |
|---|---|---|
| DE | 861 791 | 1/1953 |
| DE | 35 22 171 | 1/1987 |
| WO | WO 91/02158 | 1/1991 |
| WO | WO 98/41734 | 9/1998 |

* cited by examiner

ARRANGEMENT AT A PISTON ENGINE AND METHOD OF CONTROLLING THE PISTONS

CROSS REFERENCE TO RELATED APPLICATION

The present application is the U.S. national stage application of International Application PCT/NO01/01/003 74, filed Sep. 13, 2001, which international application was published on Mar. 21, 2002 as International Publication WO 02/23 040. The International Application claims priority of Norwegian Patent Application 20004596, filed Sep. 15, 2000.

SUMMARY OF THE INVENTION

The invention regards an arrangement for a piston engine in the form of a piston pump/engine of the type in which two or more co-operating piston cylinders, the reciprocating pistons of which have piston rods that at any time will project more or less outside the respective cylinders and be influenced by a rotatable body for control of each piston, to impart to this a predetermined displacement in the respective cylinder. This displacement is matched to the corresponding displacement of the co-operating pistons so that the controlled reciprocating pistons in the case of the pump embodiment of the piston engine contribute to impelling a fluid stream or in the case of the engine embodiment of the piston engine are driven by a fluid stream.

The invention also relates to a method of controlling controllable reciprocating pistons that, numbering two or more, form part of the piston engine (piston pump/engine), in which rotatable means have been provided for the mutual control of the piston movement, which means influence the pistons via their projecting piston rods.

As the use of e.g. hydraulic piston engines as both pumps and engines (motors) is well known, the invention will in the following essentially be explained only in connection with a piston pump, in which pistons arranged to be reciprocating in one common or in separate cylinders are designed to establish and then maintain the flow of a liquid.

As mentioned, the device according to the invention may still be used in connection with a hydraulic piston engine driven by a stream of liquid. For the sake of simplicity, the s following will essentially only refer to a piston pump or just a pump, although the engine in question may also in a known manner be used as an engine (motor).

A disadvantage of known piston pumps is the fact that they produce a fluid flow that fluctuates in time with the piston stroke. The fluctuations are undesirable, as they cause pressure variations, vibrations and acoustic noise. A known solution for reducing pressure variations consists in coupling the delivery side of the pump to an accumulator.

By letting two pistons act reciprocally on the same fluid flow, there will always be one piston executing a power stroke and impelling the liquid, while the other piston executes the return stroke. This achieves a more even flow of fluid. It is common to drive to pistons with a rotating crank, where the pistons, through their piston rods, are linked to the crank on the diametrically opposite sides of the rotational axis of the crank. Thus the pistons are arranged to work out of phase by the equivalent of 180 angular degrees rotation of the crank. A similar effect may be achieved by using a double acting piston, where fluid is impelled alternately by one or the other side of the piston.

Even with two pistons, or with one double-acting piston, considerable fluctuations (variations) occur in the fluid flow.

This is caused by the piston speed varying and being equal to zero at the dead point where the pistons switch between power stroke and return stroke. For each piston stroke, the fluid flow tends to zero every time the piston switches from power stroke to return stroke, and increases from zero as the piston switches from return stroke to power stroke. In the case of two pistons alternating in the manner explained, the fluid flow will be zero simultaneously for both pistons for every half crank rotation, i.e. for every 180 degrees.

It is known to use three pistons operated by a common crank and mutually out of phase by 120 angular degrees. By so doing, there is always one piston executing a power stroke. Thus the fluid flow never stops completely. Such so-called triplex pumps are considerably better than pumps with one or two pistons, with regard to fluctuations in the fluid flow.

Further improvement may be achieved by using even more co-operating pistons. More pistons will however lead to an increase in complexity and costs.

Combining a triplex pump with a pressure accumulator is considered to be an acceptable compromise.

It is known to control pistons in cylinder bores in a barrel-like rotor by means of an inclined guide plate that acts on piston rods that are each connected to a piston. The guide plate forms a bevel angle with the axis of the rotor, so that each piston is driven by a length of stroke determined by the bevel angle of the guide plate when the rotor turns. This solution is mostly used for small hydraulic pumps where the pumping rate can be changed by changing said angle of the guide plate.

Said known piston pump devices have a disadvantage in that the incoming fluid flow also fluctuates in a similar manner to the outgoing fluid flow. The fluctuations indicated may be quite considerable. As an example, the volume flow may—in the case of a piston rod length five times greater than the radius of the crank, and with incompressible fluid/low pressure and perfect valves—vary between 81.5 and 106.8% of the mean volume flow.

With large pumps, the fluctuation conditions indicated may cause detrimental vibrations and unnecessary noise, even with the use of a pressure accumulator on the delivery side of the pump.

It is common to represent the piston speed, and consequently the volume flow for each piston, graphically as a pure sine function of the crank angle, and in such a way that the maximum piston speed occurs at crank angles of 90 and 270 degrees. Strictly speaking, this is only correct for an infinitely long piston rod. In practise, the maximum piston speed, and consequently the maximum volume flow, occurs as the crank arm and the piston rod form a right angle, and this happens at a crank angle of less than 90 degrees and more than 270 degrees, respectively.

Thus with a graphical representation, a distorted sine curve will emerge when the piston speed is plotted as a function of the crank angle. This further contributes to a theoretically favourable displacement of phase of 120 degrees in practice giving a poorer equalisation of pressure fluctuations and more noise than that which might be expected, as an asymmetrical third harmonic component arises.

Another factor is that the greatest occurring piston speed has proven to be decisive in terms of the wear conditions in is piston pumps, as the wear increases with increasing speed and increasing operating pressure. A pump that is to operate at a high pressure, must normally be run at a lower piston speed, and consequently a lower volumetric rate, than if the same pump were to operate with the same fluid at a lower pressure.

BRIEF DESCRIPTION OF THE INVENTION

It is an object of the invention to provide an arrangement for piston engines where the conditions may be arranged in a manner that allows work with a more steady volume flow, i.e. without any substantial fluctuations, and where the basis is a piston engine in which two or more pistons work mutually out of phase.

Further, it is an object to reduce the greatest occurring piston speed in relation to known piston pumps/engines with similar dimensions and at a similar volume flow and pressure, in order to achieve a reduction in wear, or alternatively be able to increase to volume flow at the corresponding greatest piston speed and wear as for similarly dimensioned known piston pumps/engines.

In accordance with the invention, each piston in a piston pump (engine) is driven at a constant speed over part of a power stroke; this as opposed to known pumps (engines) of the same or a similar type in which the piston speed varies continuously as a sine function. At each end of a stroke, the piston speed is gradually changed to or from zero. As a working piston is decelerated to zero speed, the cooperating piston accelerates and begins a power stroke from zero speed, so that the overall outgoing volume flow is unchanged.

The effect is easily understood if one imagines each piston decelerating and accelerating linearly at the end and beginning, respectively, of each stroke. Naturally, the same effect may be achieved even if said speed variation is not linear. The point is that the sum of the speeds of the two pistons during the switching phase is constant and equal to the normal speed of a piston during the power stroke.

By maintaining a constant, greatest possible piston speed through part of the stroke, a significantly higher volume flow is achieved per power stroke than in the case of a known pump in which the same piston speed only occurs as the maximum speed at a particular point in the stroke, and in which the piston speed is otherwise lower.

From the point of view of wear, it is conceivable that a continued high speed will cause a longer part of the cylinder wall to become worn, but the equivalent wear in a more limited area will still result in the pump having to be overhauled. A pump in accordance with the invention may however be run at a considerably reduced greatest piston speed and still give the same volume flow as a known pump.

By a pump in accordance with the invention, a steady outgoing volume flow may be achieved by means of two co-operating pistons only. By letting each power stroke cover a little more than 180 degrees rotation of the pump drive shaft, an overlap is achieved for the part that exceeds 180 degrees, both pistons executing part of a power stroke at the same time. The overlapping part of a rotation may as an example be 30 degrees, where one piston decelerates steadily towards zero speed and ends its power stroke while the other piston commences its power stroke and accelerates steadily towards working speed. The return stroke must be executed at a higher speed than the power stroke, as the length of the piston stroke is to be covered in the course of a rotational angle of less than 180 degrees. This higher return speed is undesirable per se with regard to wear, but as the pressure against the piston is considerably lower during the return stroke than during the power stroke, the increased speed does not result in increased wear. Besides, the return speed of the piston is not higher than the maximum piston speed for a corresponding known piston pump.

A disadvantage of the dual piston solution described may however be that the incoming volume flow is not constant even though the outgoing volume flow is. The variations in the incoming fluid flow are comparable to similar variations in a known triplex pump.

A pump that operates in accordance with the invention, and which includes three pistons with a mutual displacement of phase of 120 degrees, may, in contrast to a corresponding known triplex pump, deliver a constant volume flow, where the magnitude of the volume flow at any time corresponds to the working speed for one piston. Two by two, the pistons then alternate with a linear speed variation and give an overall constant volume flow. By using three pistons, the behaviour of the piston speed may be the same for the power stroke and is the return stroke, as distinct from the asymmetrical behaviour explained above for a two-piston pump.

In addition, a three-piston pump would have a constant incoming volume flow. The same may be achieved by more pistons, e.g. five pistons working with a mutual displacement of phase of 72 degrees.

A favourable piston pump may be realised with six pistons working at a 60 degree phase displacement and with different piston speeds for the power stroke and the return stroke (asymmetrical). The maximum, and constant, piston speed between the change-over regions at each end of a power stroke will be lower than the maximum piston speed for a similar, known pump by a factor of 1.6, in which known pump the piston speed shows a sinusoidal behaviour.

Alternatively, a piston pump working in accordance with the invention may be run at a higher rotational speed and corresponding greater volume flow than a similar, known pump, without exceeding the maximum piston speed of the known pump.

BRIEF DESCRIPTION OF THE INVENTION

In the following, the invention will be described in greater detail by means of a first simplified embodiment of a pump with two pistons. Moreover, the behaviour of the speed and the change-over phases are explained further for pumps with more pistons, and finally, a more detailed example of a preferred embodiment of a drilling mud pump is referred to. Reference is made to the enclosed drawings, in which:

FIG. 1 schematically shows a simplified representation of a pump having two pistons driven by a cam in the form of a rotating eccentric disk/roller;

Figure 7:
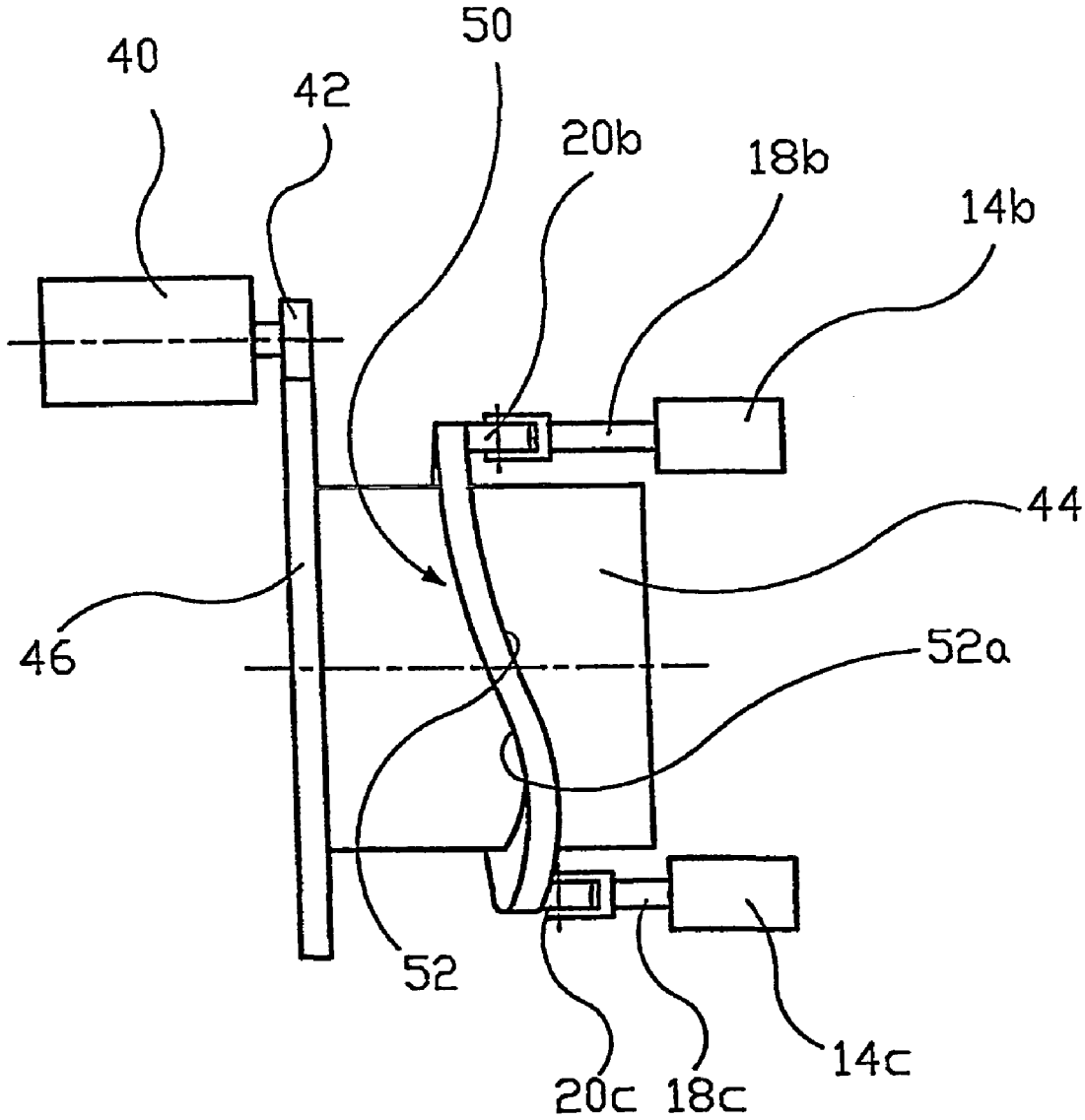
FIG. 7 is a schematic side view of a rotating drum with an outside annular cam.
Figure 8:
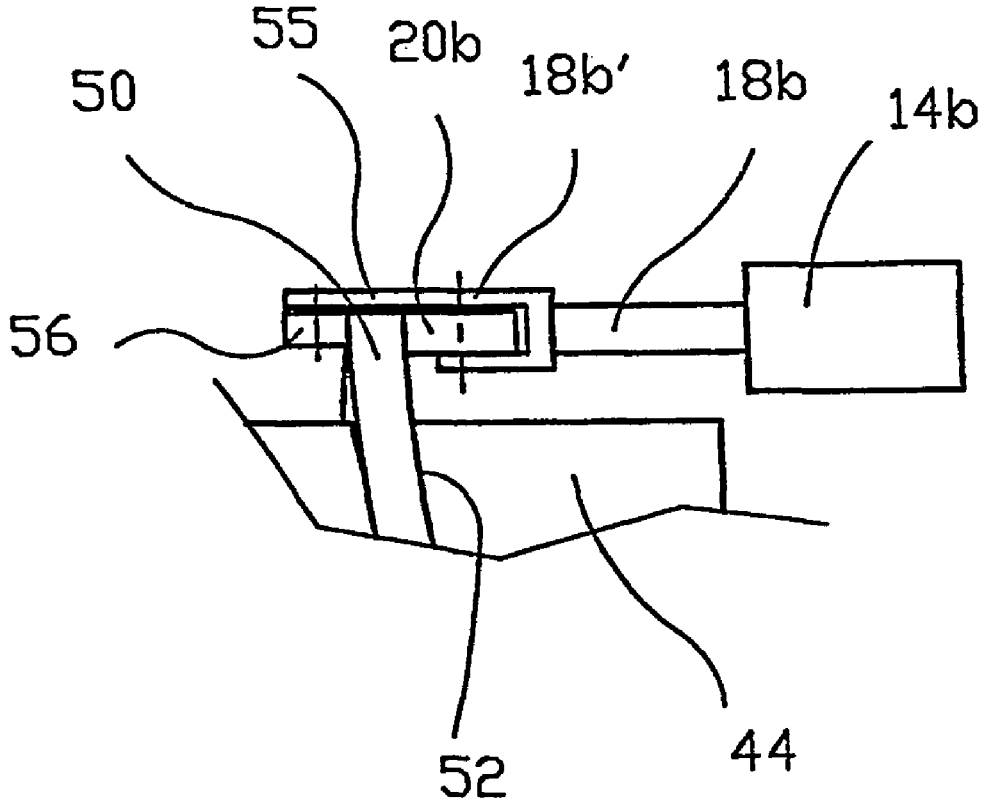
FIG. 8 shows a partial, corresponding view (cropped relative to FIG. 7) in which a counter roller is mounted on an extension of the bifurcated roller bearing support, which counter roller rolls on the back of the annular cam, i.e. on the opposite side relative to the actual cam surface.
Figure 9:
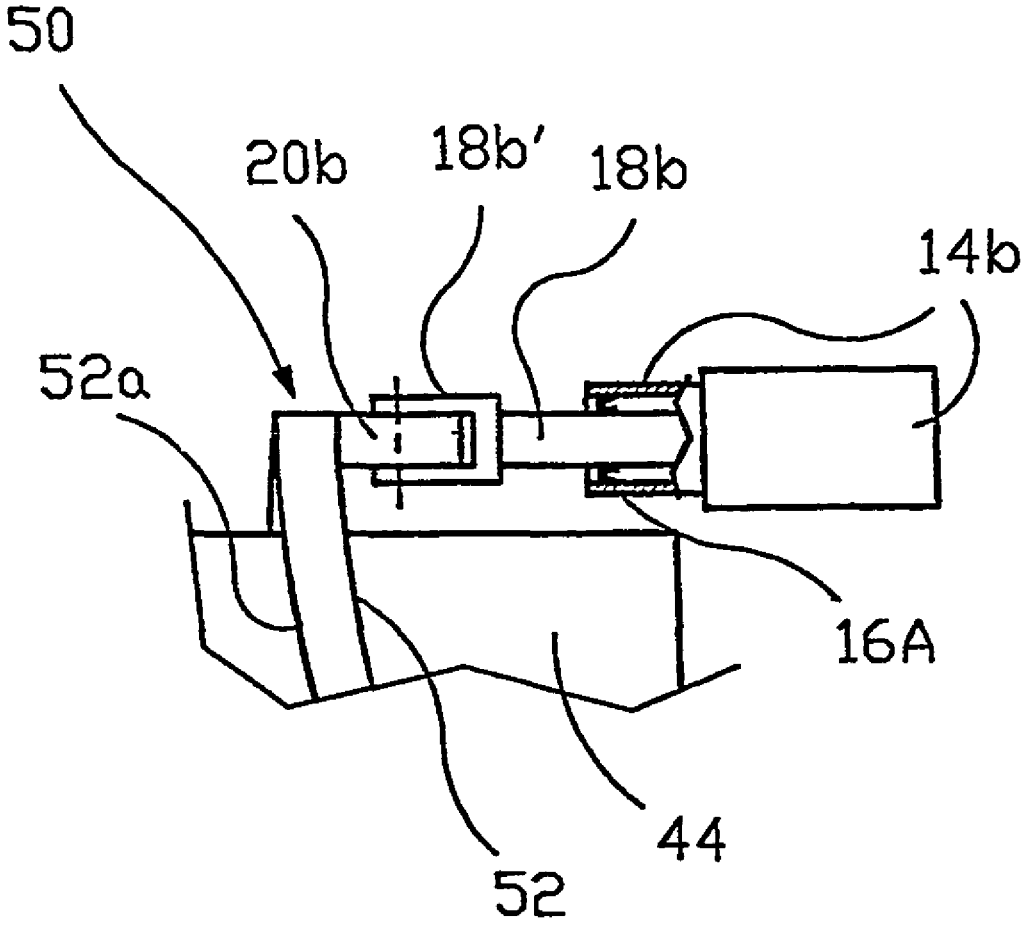
FIG. 9 shows a partial view of the counter roller embodiment corresponding to FIG. 8, in which the roller bias is based on the use of a so-called pneumatic spring, and where the roller at the end of the piston rod is pressed against the cam when the cylinder is pressurised, e.g. pneumatically.
Figure 10:
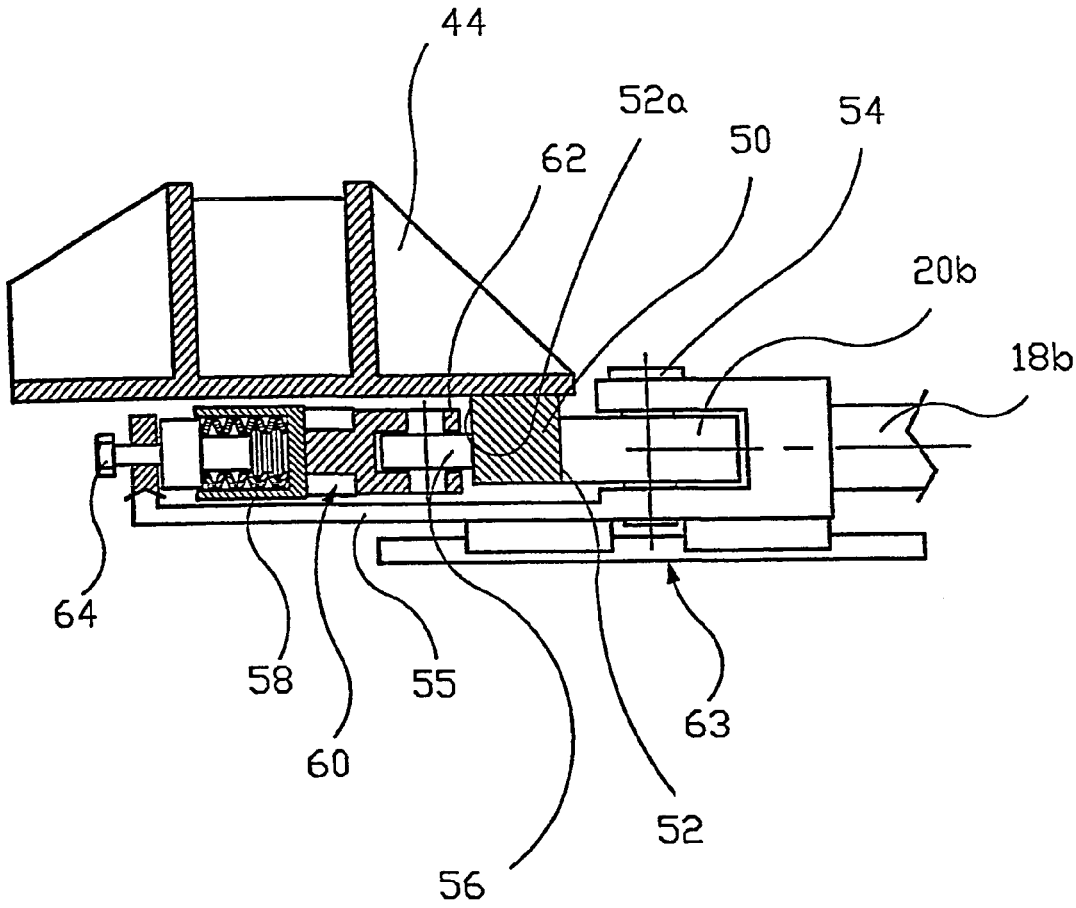
Figure 11:
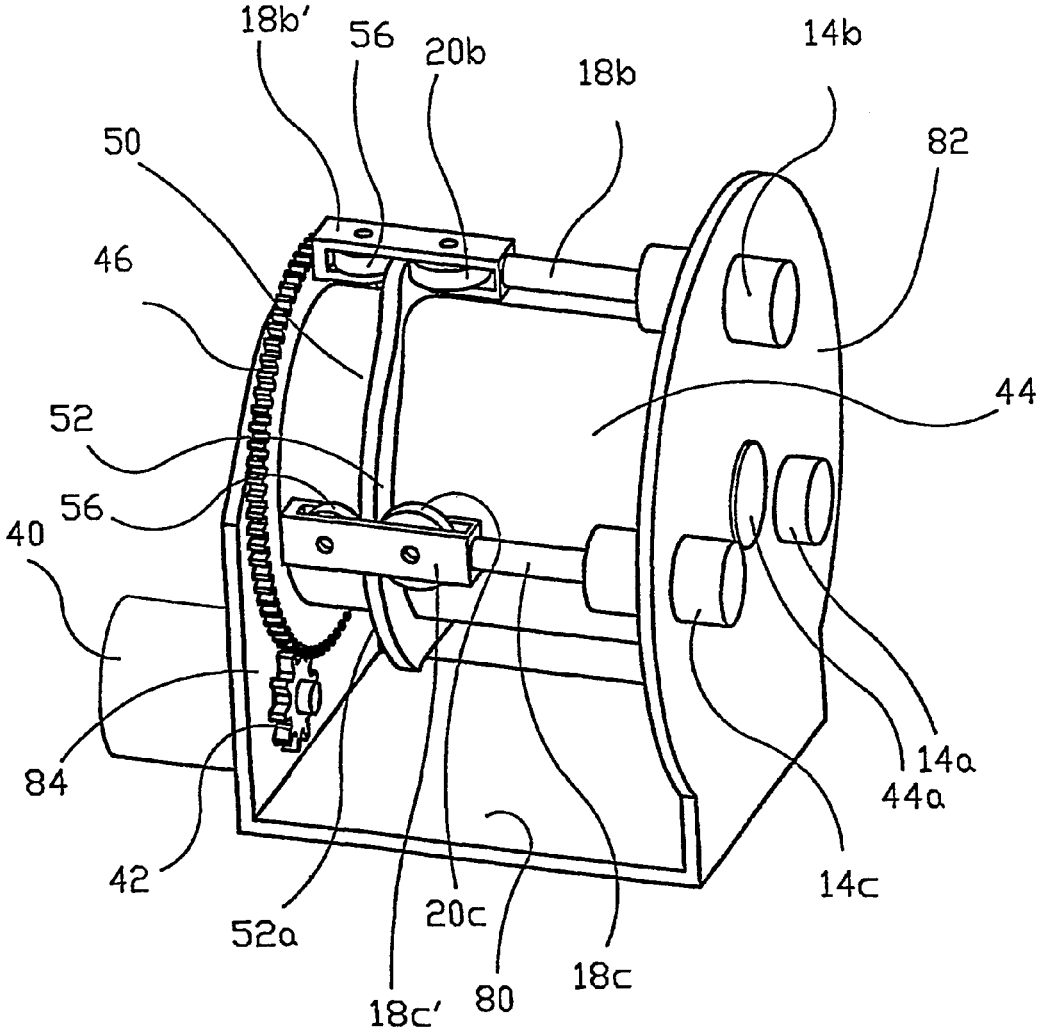

FIG. 10 shows, on a considerably larger scale than FIG. 7 and in considerably greater detail than FIG. 8, the embodiment according to FIG. 8 with a "counter roller", and illustrates how the freely rotatable roller at the end of the piston rod end in a resilient manner abuts the cam surface of the annular cam on the rotating drum, the opposite side of which cam the counter roller rotatably abuts; and FIG. 11 is a perspective view of a three-cylinder piston pump that exhibits common features with the embodiment according to FIGS. 7, 8, 9 and 10, but where the counter roller principle is maintained in combination with the use of a pneumatic spring.

DETAIL DESCRIPTION OF THE INVENTION

The following will explain the invention with reference to the drawings.

Figure 1:
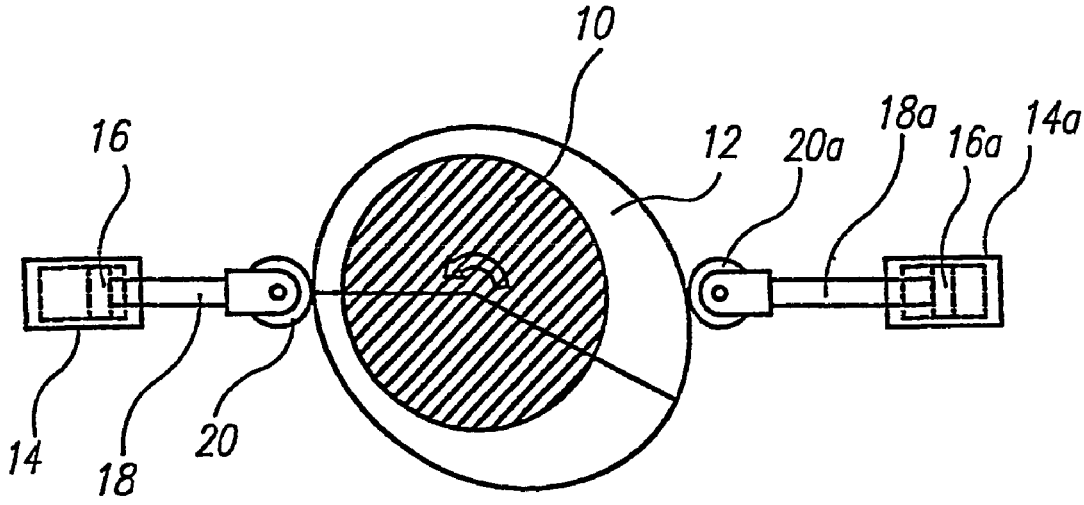

In FIG. 1, reference number 10 denotes a drive shaft that rotates in the counter-clockwise direction as indicated by an arrow. The drive shaft 10 is associated with a cam 12, the radius of which, when measured from the centre of the drive shaft 10 to the periphery of the cam 12, increases from a minimum value to a maximum value counted with an increasing rotational angle towards the right (clockwise), in order to then decrease to the minimum radius of the cam 12 upon full rotation. The maximum radius of the cam 12 is positioned such that the rotational angle (clockwise) between the minimum and maximum radii of the cam 12 constitutes 210 degrees, as shows by broken radius lines in FIG. 1.

A first cylinder 14 with a first piston 16, which cylinder is oriented in the radial direction relative to the drive shaft 10, is arranged on the diametrically opposite side of the drive shaft 10 from a second, radially oriented cylinder 14*a* with a second piston 16*a*.

The first piston 16 is associated with a first piston rod 18, which at its free end is provided with a first roller 20 designed to follow the periphery of the cam 12. The second piston 16*a* is correspondingly associated with a second piston rod 18*a*, which at its free end is provided with a second roller 20, which is likewise designed to follow the circumference of the cam 12.

Figure 2:
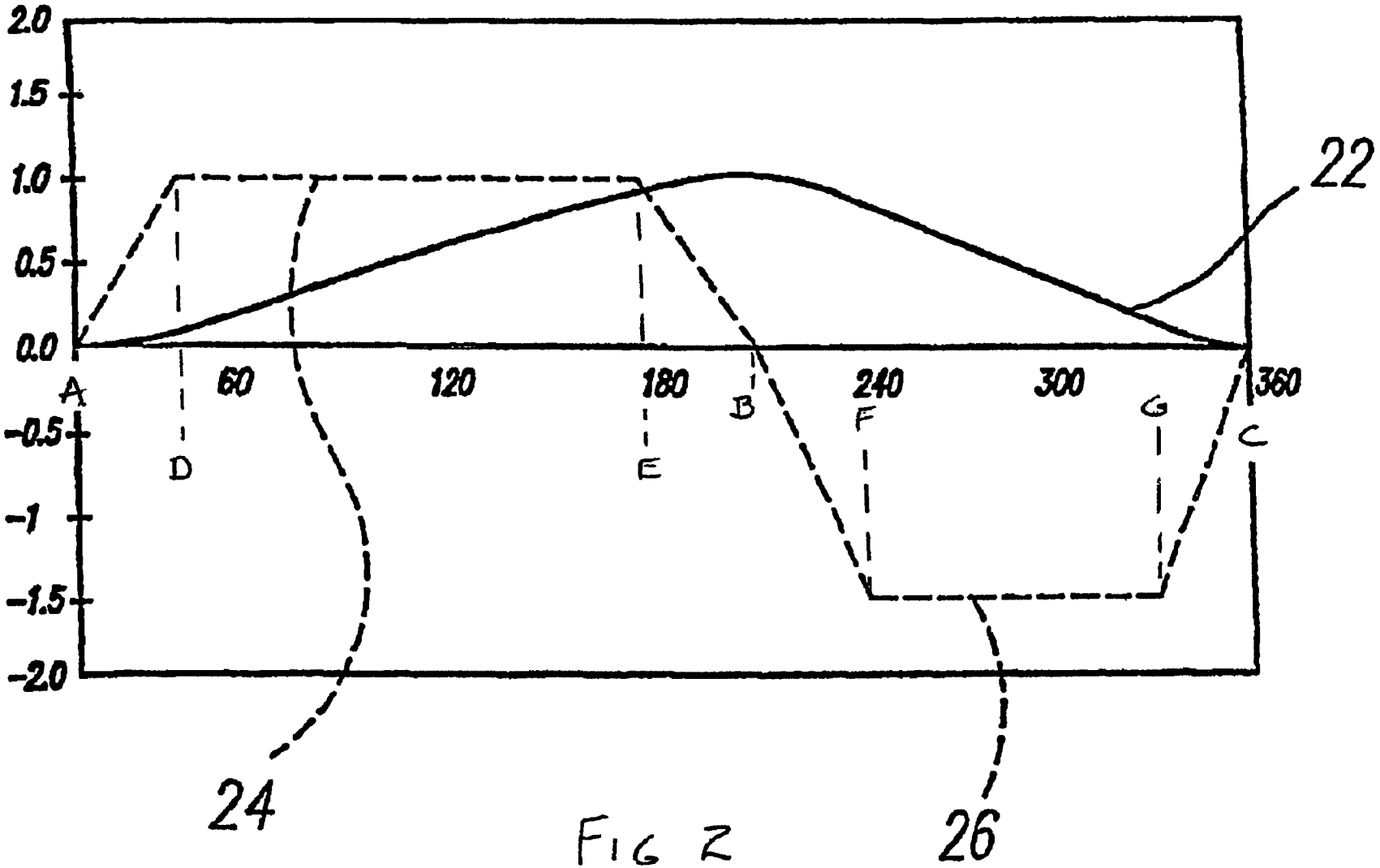
FIG. 2 shows a diagram with a curve illustrating the cam profile and piston speed for the cam and one of the pistons of FIG. 1.

In FIG. 2, the curve 22 shows the radius of the cam 12 as a function of the rotational angle of the cam 12. Thus the curve 22 shows the profile of the cam 12. The curve 24 shows the speed of the first piston 16 as a function of the rotational angle of the cam 12 at a constant rotational speed for the drive shaft 10 and the cam 12.

The horizontal scale gives the rotational angle for the cam 12 from 0 to 360 degrees. The vertical scale gives the radius of the cam 12, normalised so as to give the maximum radius, which occurs at 210 degrees, a positive value of 1.0, and so as to normalise the speed of the piston 16 during a power stroke to a value of 1.0.

As appears from the curve 24, the maximum speed of the piston 16 during the return stroke is equal to 1.5 or 50 percent higher than during the power stroke. What piston speed these normalised values correspond to, will obviously be dependent on the rotational speed of the drive shaft 10 and the cam 12, and what the normalised radius equal to 1.0 corresponds to in real dimensions.

Figure 3:
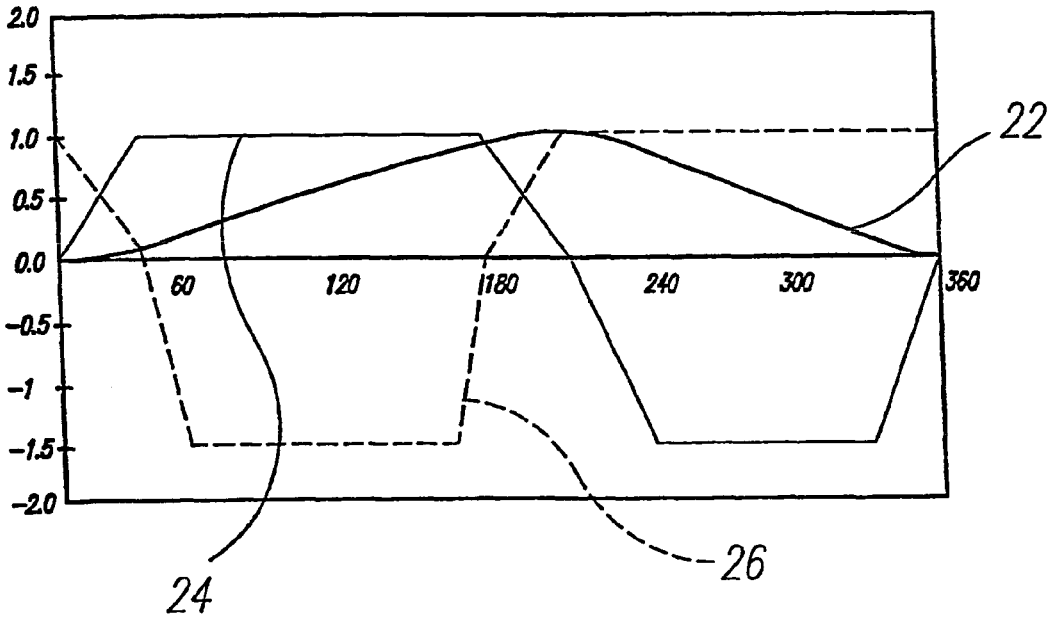
FIG. 3 shows a diagram corresponding to FIG. 2, but in which the piston speed for the other piston of FIG. 1 is also shown.

The dotted curve 26 in FIG. 3 shows how the speed of the second piston 16*a* behaves when the cam 12 is rotated to the left relative to the initial position of FIG. 1. At an early stage, more specifically between 0 and 30 degrees, the first piston 16 is at the beginning of a power stroke and runs at a linearly increasing speed, while the second piston 16*a* is at the end of a power stroke and runs at a linearly decreasing speed. The sum of the two positive piston speeds is constant and equal to 1.0. From 30 to 180 degrees, the first piston 16 executes the main part of the power stroke at a constant speed equal to 1.0, while the second piston 16*a* executes its return stroke and sucks fluid into the second cylinder 14*a*.

Figure 4:
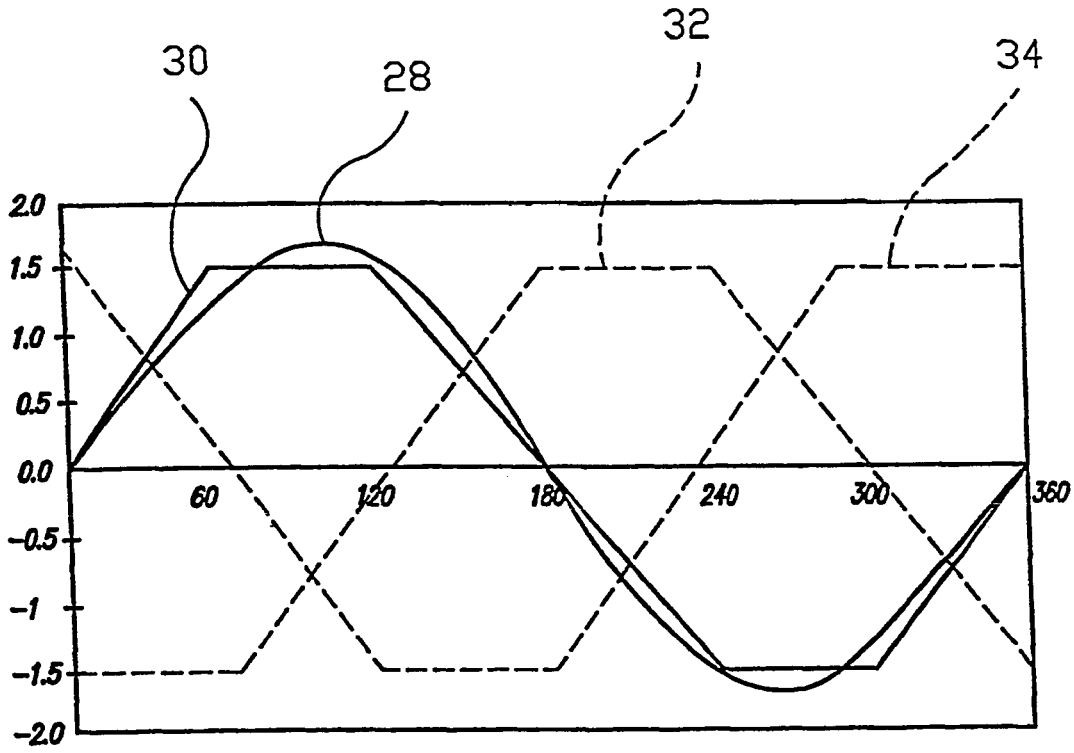
FIG. 4 shows a diagram of piston speed for a three-cylinder pump.

FIG. 4 shows speed curves for a pump in which three pistons work 120 degrees out of phase. A sinusoidal speed curve 28 for a normal crank-operated piston is shown as a reference. The curves 30, 32 and 34 apply to the first, second and third pistons respectively. As appears from the curves 30, 32 and 34, there is always one piston working at a constant speed, or two working pistons that alternate so as to make the sum of their speeds equal to the working speed of one piston.

Figure 5:
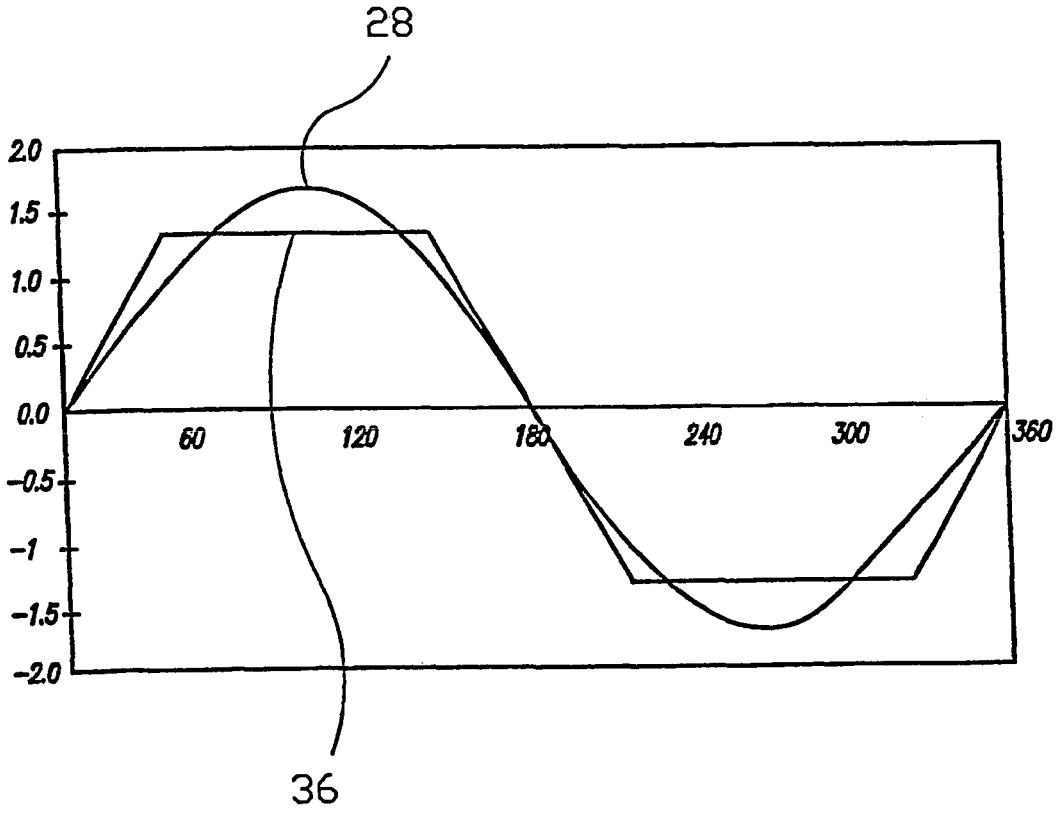
FIG. 5 shows a diagram of piston speed for a five-cylinder pump.

FIG. 5 shows a speed curve 36 for a piston in a pump in which five pistons work 72 degrees out of phase. A sinusoidal speed curve 28 for a normal crank-operated piston is shown as a reference. The curves for the remaining four pistons are not shown. As appears from FIG. 5, the working speed of the piston is constant through a significantly greater part of the first 180 angular degrees than for the reference curve 28, while at the same time, the working speed of the piston is also significantly lower than for a crank-operated piston represented by reference curve 28.

Figure 6:
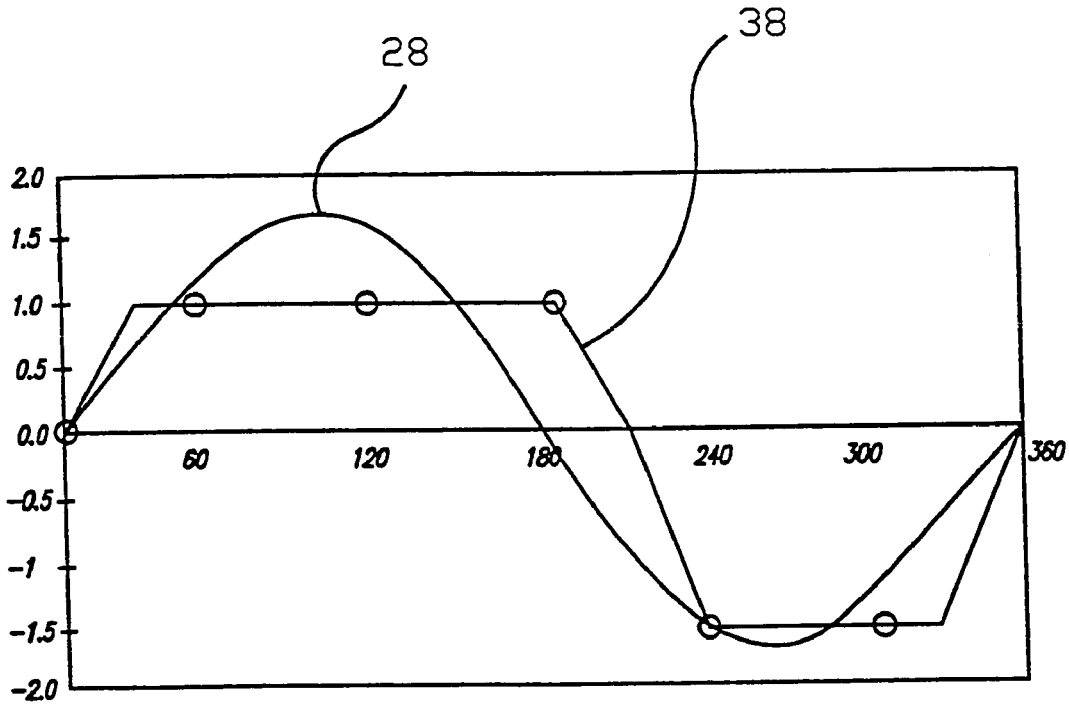
FIG. 6 shows a diagram of piston speed for a six-cylinder pump.

FIG. 6 shows a speed curve 38 for a piston in a pump in which six pistons work 60 degrees out of phase. A sinusoidal speed curve 28 for a normal crank-operated piston is shown as a reference. The curves for the remaining five pistons are not shown. As appears from FIG. 6, the working speed of the piston is constant through a significantly greater part of the first 180 angular degrees than for the reference curve 28, while at the same time, the working speed of the piston is also significantly lower than for a crank-operated piston represented by reference curve 28. The speed curve 38 is asymmetrical, so that the return stroke covers a smaller rotational angle than the power stroke, thus taking place at a greater piston speed.

In an example of an embodiment of a piston pump shown schematically in FIGS. 7, 8 and 10, a motor 40, the discharge shaft of which is provided with a cogwheel 42, is designed to drive a rotatable drum 44 by the cogwheel meshing with an outside rim 46 on the drum 44.

The outside of the drum 44 is further provided with an encircling annular cam 50, one side of which is formed as a profiled cam surface 52.

Outside of and in parallel with the drum 44 is provided at least one piston cylinder 14*b*, 14*c*, where a piston (not shown) is associated with a piston rod 18*b*, 18*c*, the free end of which is designed to follow the cam surface 52 when the drum 44 rotates, and thereby drive said piston (not shown) in the cylinder 14*b*, 14*c* as explained previously.

In a preferred embodiment, six piston cylinders 14*b*, 14*c*, . . . distributed equidistant around the drum 44 in a practical embodiment of the invention will be connected to a common manifold system. Each piston cylinder 14*b*, 14*c*, . . . is in a known manner provided with the valves and couplings that are required for the cylinder to be able to function as a pump cylinder.

By such a six-cylinder piston pump, the drum is run by two motors, one on either side of the drum 44.

FIG. 10 illustrates how the free outer end of the piston rod 18, which end is actually constituted by that point on a rotatable abutment roller 20*b* which is most remote from the cylinder 14*b*, is brought to maintain resilient abutment against the cam surface 52 of the annular cam 50. The elastic/resilient abutment of the abutment roller 20*b* against the cam surface 52 ensures that the peripheral area of the roller at follows the non-circular course of the cam surface 52 360 degrees around the rotational axis of the drum 44 all the time.

In order to achieve this possibility of resilient motion for the roller 20*b* (and naturally also for the remaining abutment rollers 20*a*, 20*c*, . . . ) in the axial direction of the respective piston cylinders/piston rods, a bifurcated head 18*b*' for the rotatable support of the roller 20*b* is, by means of a transverse bolt 54, formed at the end portion of the actual piston rod in the constructive sense (the actual piston rod end in the functional sense being formed by the roller 20*b*, or more specifically the point of this which at any time is the outermost of the periphery in the axial direction of the piston rod 18*b*), one branch of which bifurcated head 18*b*', via a holder 55, supports spring loaded abutment means in the form of a small rotatable roller/wheel 56, the axis of which is parallel to the rotational axis of the abutment roller 20*b*.

The peripheral surface of this smaller roller/wheel 56 resiliently supports and abuts the back 52*a* of the peripheral surface of the cam 50, which surface, unlike the actual cam surface 52, can follow a circular ring surface.

The spring 58 for this small roller/wheel may for instance be constructed from several joined disk springs that are kept in place inside a lying-down cup shaped part of a bearing part 60 that, among other things, supports a bifurcated end piece 62 for the support of the roller/wheel 56.

64 denotes an adjusting screw for adjusting the small roller/wheel 56 relative to the cam 50 (the circular rear side 52*a* of the cam) in the axial direction of the piston rod 18*b*, while 63 indicates a slide guide associated with the cam roller arrangement 50-20*b*.

As mentioned, said preferred embodiment includes six piston cylinders spaced evenly (with the same angular distance) around the drum, and these piston cylinders will in this preferred embodiment with advantage be coupled to a common manifold system.

The bifurcated head 18*b*', 18*c*' may in some embodiments be of the same size as the cylinder 14*a*–14*c* . . . at the other end of the piston rod 18*a*–18*c* . . . .

The means of ensuring that the rollers 20 maintain their contact with the opposite cam surface 52 at all times, take various forms. In general, they must be capable of ensuring that the pressure on the suction side is always high enough to balance the frictional, gravitational and inertial forces that seek to lift the roller off the cam and thereby terminate the guiding co-operation between them. FIGS. 8 and 10 propose the use of a counter roller positioned to run on the back of the cam 50. Alternatively, biasing may be used, for instance pneumatic as indicated in FIG. 9, in which an annular piston 16A wedged on an intermediate part on the piston rod 18*b*, thus following its 18*b* movements, forces the roller 20*b* against the cam 50 when the cylinder 14B is pressurised upon supply of compressed air. Instead of this pneumatic spring biasing embodiment, the biasing could have been provided via a mechanical route.

By the embodiment according to FIG. 11, pneumatic springs may be used, and the normally bifurcated holder 18*b*', 18*c*' at the end of the piston rods 18*a*–18*c* of the respective pneumatic cylinders 14*a*–14*c* may be formed so as to allow both the abutment and counter roller 20*b*, 20*c*, in pairs 56 respectively, to be supported in each holder. Moreover, the embodiment of FIG. 11 has the same driving and transmission mechanism 40, 42, 46 as that of FIG. 7, the gearing 42, 46, the drum 44 with a 360 degree encircling cam ring part 50 and the three equidistantly (with an angular spacing of 120 degrees) positioned piston cylinders 14*a*–14*c* being supported in two spaced apart, parallel side walls 82, 84 of a frame structure, where a mounting plate 80 connects the two side walls 82, 84. Reference number 44*a* denotes one of the axle journals of the drum 44.

What is claimed is:

1. An arrangement for a piston engine, the arrangement comprising:

an angularly rotatable cam having a camming surface, the camming surface being definable by a graph in which the abscissa represents a rotational angle for the cam between 0° and 360° and the ordinate represents the distance of the cam surface from a reference, said cam surface having a first sector occupying a portion extending along the abscissa and a second sector occupying a portion extending along the abscissa, said first sector having positive slopes with respect to said reference, said positive slopes including an intermediate portion of a constant slope, said second sector having negative slopes with respect to said reference, said negative slopes including an intermediate portion of constant slope; and a plurality of cylinder-pistons equally spaced around a periphery of said cam and engaging the cam, the number of pistons and the positive slopes arranged such that when the cam surface is rotated at a constant speed, the sum of the linear speeds of all pistons following the positive slopes of the first sector is constant.

2. The arrangement according to claim 1, wherein the sum of the linear speed of all pistons following the positive slopes of the first sector is equal to the sum of the linear speeds of all pistons following the negative slopes of the second sector.

3. The arrangement according to claim 1 wherein said cam surface is asymmetrical along said abscissa with said first sector of said camming surface occupying a greater portion of the abscissa, and hence a greater rotational angle, than said second sector and wherein the negative slope of said constant slope intermediate portion of said second sector is greater than the positive slope intermediate portion of said first sector.

4. The arrangement according to claim 3 wherein the number of said cylinder-pistons is a multiple of an even number equal to or larger than four.

5. The arrangement according to claim 4 wherein the number of said cylinder-pistons is equal to six.

6. The arrangement according to claim 1 wherein said cam is symmetrical along said abscissa and the number of cylinder-pistons is a multiple of an odd number equal to or larger than three.

7. The arrangement according to claim 1, wherein said pistons of said cylinder portion have piston rods, said arrangement further comprising a rotatable roller coupled to a free outer end of each piston rod, the rotatable roller comprising an abutment surface that abuts the camming surface of the cam during rotation.

8. The arrangement according to claim 1, wherein the rotatable cam comprises an encircling cam ring arranged on a rotatable body.

9. The arrangement according to claim 7, wherein said rotatable roller is arranged to maintain resilient abutment against the camming surface.

10. The arrangement according to claim 9, wherein each piston rod comprises an end for support of the respective rotatable roller, the piston rod end comprising a bifurcated head designed to rotatably receive the rotatable roller between U-branches; the arrangement further comprising a transverse bolt coupling the rotatable roller to the bifurcated head.

11. The arrangement according to claim 7, further comprising means for maintaining the abutment surface of the rotatable roller on the camming surface of the cam.

12. The arrangement according to claim 11, wherein the means for maintaining the abutment surface of the rotatable roller on the camming surface of the cam comprise a biasing means.

13. The arrangement according to claim 10, wherein the bifurcated head supports an axially projecting holder that ensures that the rotatable roller remains in spring-loaded contact with the camming surface of the cam.

14. The arrangement according to claim 13, wherein the rotatable cam comprises an encircling cam ring arranged on a rotatable body, wherein said cam ring has a rear ring surface; wherein the axially projecting holder is U-shaped and comprises a first U-branch that is directed axially away from the free outer end of the piston rod, and a second U-branch, the second U-branch connected to the first U-branch via a U-web; wherein the U-web forms a transverse connecting piece that is axially aligned towards the piston rod and supports a contact wheel; and wherein the contact wheel comprises a peripheral surface that abuts the rear ring surface of the cam ring in a spring-loaded manner, opposite the camming surface of the cam, to keep the rotatable roller in constant resilient abutment against the camming surface.

15. The arrangement according to claim 10, wherein the bifurcated head is arranged to support the rotatable roller and a counter roller on the opposite side of a cam ring relative to the camming surface.

16. The arrangement according to claim 12, wherein the biasing means comprises one of a pneumatic device or a mechanical device.

17. The arrangement according to claim 7, wherein the cam comprises a cam disk arranged normal to an axis of rotation and having a peripheral camming surface engaging said piston rods for moving the piston rods generally radially with respect to the cam disk.

18. The arrangement according to claim 1, characterized in that the cam comprises a cam disk arranged normal to an axis of rotation and having a peripheral camming surface engaging said cylinder-pistons for moving the pistons generally radially with respect to the cam disk.

* * * * *